United States Patent [19]

Bahia

[11] 4,334,401

[45] Jun. 15, 1982

[54] PROCESS FOR MAKING TEXTURED YARN

[75] Inventor: Hardev S. Bahia, Coventry, England

[73] Assignee: Courtaulds Limited, London, England

[21] Appl. No.: 145,703

[22] Filed: May 1, 1980

[30] Foreign Application Priority Data

May 3, 1979 [GB] United Kingdom ..... 15464

[51] Int. Cl.[3] ..... D02G 1/02; D02G 3/00; D02G 3/34

[52] U.S. Cl. ..... 57/6; 57/2; 57/209; 57/331

[58] Field of Search ..... 57/2, 5, 6, 13, 309, 57/310, 328, 331, 334, 337–340, 209

[56] References Cited

U.S. PATENT DOCUMENTS

| | | | |
|---|---|---|---|
| 2,745,240 | 5/1956 | Brant | 57/2 X |
| 3,001,358 | 9/1961 | Mayner | 57/2 X |
| 3,685,268 | 8/1972 | Sequin | 57/6 X |
| 4,062,177 | 12/1977 | Kojma et al. | 57/2 X |
| 4,095,403 | 6/1978 | Beraud et al. | 57/2 X |
| 4,164,836 | 8/1979 | Tanae et al. | 57/2 |

*Primary Examiner*—Donald Watkins

*Attorney, Agent, or Firm*—Davis, Hoxie, Faithfull & Hapgood

[57] ABSTRACT

A filament yarn of greater than 60 percent extensibility is combined with a carrier yarn. The combined yarn is false-twisted under tension in a unit employing rotary friction elements so that the filaments of the extensible yarn break intermittently while the carrier yarn remains intact to produce a spun-like textured yarn. The tension during false-twisting may be increased to a level at which the broken filaments snarl and form slubs in the yarn. The process may be carried out with no heat setting of the false-twist to form crimps. Suitable extensible yarns include undrawn and partially-orientated yarns, polyamide and polyester yarns, and suitable carrier yarns include fully-drawn filament yarns and spun yarns.

7 Claims, 1 Drawing Figure

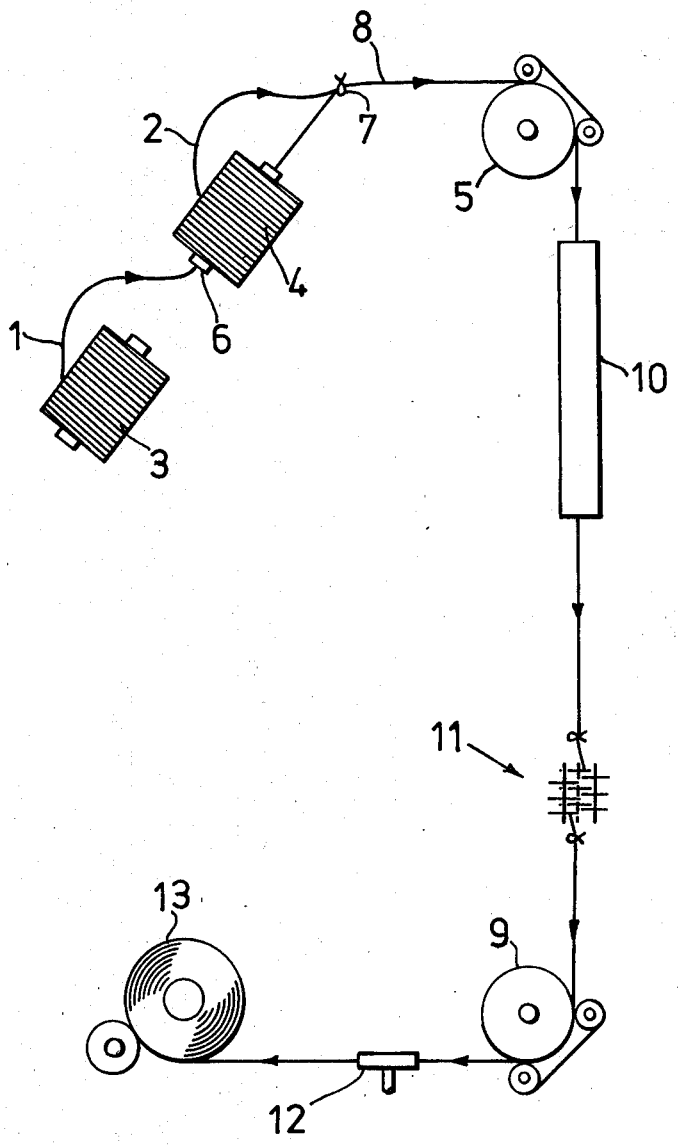
8
7
2
5
4
1
6
10
3
11
13
9
12

PROCESS FOR MAKING TEXTURED YARN

This invention is concerned with a process for making a textured yarn and the yarn produced thereby. The conventional way of texturising continuous filament yarns is by a crimping process such as false-twist crimping which imparts bulk and elasticity. The handle and appearance of such yarns is different from spun staple yarns and it has been proposed to simulate the latter more closely by breaking some of the continuous filaments to provide free fibre ends along the yarn which makes it "spun-like".

The present invention aims to provide a simple and versatile process for making a textured yarn of a spun-like character.

According to the invention, a process for making a textured yarn comprises combining a carrier yarn component with an extensible yarn component comprising continuous filaments of a synthetic polymeric material and having an extensibility of greater than 60 percent, and false-twisting the combined yarn under tension using a false-twist texturising unit employing rotary friction elements so as to break at least some of the filaments of the extensible yarn component intermittently along the length of the yarn whilst maintaining the carrier yarn component substantially intact.

The invention includes the textured yarn produced by the process of the invention which has a spun-like appearance and handle by virtue of the broken filament ends distributed over its surface. Usually, filament loops are present on the surface as well. Under certain conditions of production the yarn may also have slub effects distributed along its length.

The carrier yarn component may be any yarn which is capable of withstanding the texturising process without breaking, and both continuous filament yarns and spun staple yarns may be used for this component. Whilst it may seem a contradiction to use a spun carrier yarn in a process for making a spun-like yarn by breaking continuous filaments, in fact the process of the invention proves a very useful way of combining the spun yarn component and the continuous filament yarn component. The resulting yarn is enhanced in aesthetic properties, is integral, and can give interesting differential dye effects. The Examples show the use of cotton and acrylic spun yarns as the carrier yarn component and indeed any spun yarn, whether of natural, regenerated or synthetic fibres, may be used providing it has the requisite strength.

If a continuous filament yarn is used as the carrier yarn component it may comprise synthetic or regenerated filaments including regenerated cellulose and cellulose acetate filaments, and filaments of polyester, polyamide, polyolefin, acrylic and modacrylic polymers. The yarn is preferably stable against substantial shrinkage. Conventional drawn yarns are suitable as are synthetic yarns produced by high speed spinning. In the latter case substantially fully-drawn yarn may be produced either directly if the spinning speed is sufficiently high or after subsequent drawing.

The extensible synthetic filament yarn component may comprise any having an extensibility greater than 60% and which will break intermittently on being passed under tension through the friction texturising unit. Polyester and polyamide yarns are preferred and undrawn yarns or partially-orientated yarns (POY) can give the desired degree of extensibility. For example, an undrawn nylon 6 (60 d.tex/20 filaments) yarn spun at a spinning speed of 1000 m/m (meters/minute) has an extensibility of 248 percent and a poly(ethylene terephthalate) POY yarn (80 d.tex/50 filaments) spun at 3,200 m/m has an extensibility of 86 percent.

The carrier yarn component and the extensible yarn component may be combined simply by passing them contiguously through a guide. It is preferred, however, to wrap the extensible yarn component around the carrier yarn component with a low wrapping twist, as by mounting a package of the extensible yarn on a hollow spindle and withdrawing it overend together with the carrier yarn which passes through the hollow spindle.

The false twist texturising unit may be any suitable commercial unit of the friction element type including those using friction bushes or intermeshing stacks of friction discs. The latter are preferred and suitable units are made by Barmag AG, FAG and Ernest Scragg and Sons Limited. The unit may be mounted on a machine providing feed package mounting, draw rolls, yarn tensioning means and package take-up equipment. The yarn tension as it passes through the texturising unit may be provided by feed rolls which positively feed the yarn to the unit at a small underfeed with respect to the draw rolls. Alternatively, the yarn may be passed through a yarn tensioning device, for example a hysteresis disc or a gate tensioner.

The tension in the yarn is required to give adequate process control but it should not be so excessive as to break or damage the carrier yarn component. Obviously, greater tensions may be employed when this component is a fully-drawn continuous filament synthetic yarn than when it is a spun yarn or a cellulose acetate yarn. The optimum tension varies according to the choice of yarn components and the desired effect in the product yarn but for a given feedstock yarn the level of tension which provides the desired degree of filament breakage is readily determined.

In general, higher tensions produce a higher degree of breakage. However, as the tension is increased above the optimum for filament breakage, another interesting phenomenon takes place; slubs are formed in the product yarn and appear to be randomly distributed. These slubs are formed not by virtue of thick and thin portions in the filaments as caused by differential drawing, but by snarling of the broken filaments. As such they have the advantage of being dyeable to the same shade of colour as the main body of the filaments.

The texturising unit produces false-twist in the yarn which runs back along the yarn being fed to the unit. As with conventional false twist texturising, the false twist can be set in to produce crimp by heating a section of the false twist yarn. This can be done if the yarn end-use requires it to have the extra bulk produced by crimping, or if the carrier yarn needs to be stabilised against excessive shrinkage. However, since a spun-like texture is already provided by the broken filaments, in many cases there need be little or no crimping in addition, and advantage can be taken of foregoing heating or of heating at lower temperatures than usual in crimping processes.

In fact, a process which does not heat the yarn prior to the texturising unit has a number of important advantages. At room temperature, the filaments of the extensible yarn component break more readily making the process easier to control, and the filament cross-section is less distorted by the friction elements of the texturising unit. Distortion can produce glitter which would reduce the spun-like character of the yarn. Also, yarn which has not been subjected to the high setting temperatures used in texturising, dyes more readily, and this results in the ability to dye to the same shades at reduced temperatures and/or with less dye. For example, poly(ethylene terephthalate) yarns which have been texturised at room temperature by the process of the invention may be dyed satisfactorily at the boil using aqueous disperse dye liquors.

The texturised yarn may be taken up on package by side-winding or by twisting. As some consolidation of the yarn is desirable, it may be interlaced by passing it through a fluid jet interlacer prior to take-up. This is particularly beneficial in the case when slub yarn is produced because interlacing stabilises the slubs against them being pulled out.

The invention is illustrated by the accompanying drawing in which the single FIGURE is a schematic elevation of one station of a friction false twist texturising machine.

In the drawing, carrier yarn 1 and extensible yarn 2 are withdrawn overend from cheese packages 3 and 4 respectively by feed rolls 5 of the 'Casablanca' apron type. The carrier yarn 1 passes through the tube 6 on which the cheese of extensible yarn is wound so that the extensible yarn 2 is wrapped around the carrier yarn 1 as they pass together through the guide 7.

The combined yarn 8 is then forwarded between the feed rolls 5 and the draw rolls 9 (also of the 'Casablanca' apron type) and is put under the required degree of tension by regulating the relative speeds of the draw and feed rolls. Prior to the draw rolls, the yarn 8 passes successively through a heater 10 and a friction false twisting unit 11. The heater 10 is optional and if present need not be used; it may be of the contact or radiant type. The friction false twisting unit 11 is shown diagrammatically as having intermeshing stacks of rotating friction discs. A suitable commercial unit is that made by Barmag AG using three stacks, each having three discs, mounted at the corners of a triangle. The discs are preferably ceramic at least at the rims where they contact the yarn. The frictional action of the rotating discs on the yarn passing over their rims is to false twist it and this action, in which relative slippage of the yarn component over the disc rim takes place, results in the extensible yarn component breaking intermittently to impart texture to the yarn. After passing through the draw rolls 9, the textured yarn is interlaced by an air jet interlacer 12, and collected as a side-wound package 13.

The invention is further illustrated by the following Examples in which equipment as illustrated in the drawing was used with a Barmag texturising unit having ceramic discs. The yarns are identified by decitex and number of filaments in the usual way, for example 167/100. The polyester yarn is a poly(ethylene terephthalate) yarn. The heater was not used in Examples 1 to 10.

EXAMPLE 1

Carrier yarn—100/25 POY polyester spun at 5000 m/min
Extensible yarn—167/100 POY polyester spun at 3200 m/min
Feed rolls speed (m/min)—224
Draw rolls speed (m/min)—248
Take-up speed (m/min)—244
Spindle speed of Barmag unit (r.p.m.)—12,000
Air pressure of interlacing jet (kg/cm$^2$ gauge)—4.9

The product yarn was a 100 percent polyester yarn with the soft handle and the appearance of a spun yarn. Its properties were measured and are shown in the table below in comparison with a polyester spun yarn of 24.6 Tex (24's cotton count).

| Properties | Example 1 | Spun Yarn |
|---|---|---|
| Decitex | 256 | 250 |
| Breaking load (centiNewtons (cN)) | 395 | 399 |
| Tenacity (cN/Tex) | 15.43 | 15.96 |
| Breaking extension (percent) | 32.4 | 31.3 |
| Initial modulus (cN/Tex/100 percent extension) | 172.5 | 226.2 |
| Boiling water shrinkage (percent) | 6.4 | 0.4 |
| Specific volume (ccs/gm) | | |
| before boiling | 6.1 | 3.5 |
| after boiling | 13.0 | 3.7 |
| Moisture content (percent)(measured at 20° C. and 67 percent relative humidity) | 0.63 | 0.47 |
| Interlacing knots/meter | 84 | — |
| Number of broken filaments/10 cm yarn length | 21 | — |
| Number of surface loops/10 cm yarn length | 280 | — |

The product yarn was used to make a plain weave fabric as both warp and weft, with 22 picks/cm and 23.6 ends/cm. The resulting fabric, which was 100 percent polyester fibre, had an attractive handle and resembled a good quality polyester/cotton fabric.

The product yarn was also used to make a woven fabric of a moss-crepe construction (26.7 picks/cm and 34.2 end/cm) in which it comprised the weft yarn with a warp of 100/36 false twist texturised "Lirelle" (Trade Mark) polyester yarn. The crepe fabric had a spun-look and a soft handle.

EXAMPLE 2

Carrier yarn—44/10 fully drawn "Celon" (Trade Mark) nylon 6
Extensible yarn—80/50 POY polyester spun at 3200 m/min
Feed rolls speed (m/min)—180
Draw rolls speed (m/min)—200
Take-up speed (m/min)—180
Spindle speed of Barmag unit (r.p.m.)—10,000
Air pressure of interlacing jet (kg/cm$^2$ gauge)—5.6

The product yarn had a spun-look and gave a soft handle in single-jersey fabric produced by circular knitting.

The knitted fabric was dyed with an aqueous dye liquor containing 0.5 percent by weight of the acid dye Nylsan Blue EGL (Colour Index No. Acid Blue 72) at a 50:1 liquor:goods ratio. The fabric was entered into the dye liquor at a liquor temperature of 50° C., and then the temperature of the liquor was raised to the boil and held there for 30 minutes. The dyed fabric was rinsed with water, hydro-extracted and dried. The nylon 6 component was dyed blue and the polyester component was undyed so that the fabric had a marl appearance.

Some of the dyed fabric was further dyed with an aqueous dye liquor containing 0.5 percent by weight of the disperse dye Palanil Blue NB (Colour Index No. Disperse Blue 56) at a 40:1 liquor:goods ratio. The same dye cycle and after-treatment sequence were used. The fabric was dyed to a substantially uniform shade of blue. It retained its soft handle and spun-look.

EXAMPLE 3

Carrier yarn—150/25 continuous filament viscose rayon
Extensible yarn—80/50 POY polyester spun at 3200 m/min
Feed rolls speed (m/min)—186
Draw rolls speed (m/min)—200
Take-up speed (m/min)—192
Spindle speed of Barmag unit (r.p.m.)—9,000
Air pressure of interlacing jet (kg/cm$^2$ gauge)—5.6

The product yarn was circular-knitted to give a single jersey fabric which in handle and appearance resembled a polyester/cotton fabric made from spun yarn. A marl effect was produced by dyeing it with a disperse dye as described in Example 2.

EXAMPLE 4

Carrier yarn—cotton spun yarn of 17.4 Tex (34's cotton count)
Extensible yarn—60/20 undrawn "Celon" nylon 6 yarn spun at 1000 m/min
Feed roll speed (m/min)—196
Draw roll speed (m/min)—200
Take-up speed (m/min)—192
Spindle speed of Barmag unit (r.p.m.)—9,000
Air pressure of interlacing jet (kg/cm$^2$ gauge)—5.6

The false-twist was applied to the combined yarn components in the same sense as that of the true twist in the spun cotton yarn. The resulting yarn retained the spun yarn appearance and handle of the cotton yarn component, and when circular knitted produced an attractive single jersey fabric. The fabric was dyed to a substantially even blue shade using an acid dye as described in Example 2.

EXAMPLE 5

Carrier yarn—"Courtelle" (Trade Mark) acrylic spun yarn of 18.4 Tex (32's cotton count)
Extensible yarn—60/20 undrawn "Celon" nylon 6 yarn spun at 1000 m/min
Feed rolls speed (m/min)—196
Draw rolls speed (m/min)—200
Take-up speed (m/min)—192
Spindle speed of Barmag unit (r.p.m.)—9,000
Air pressure of interlacing jet (kg/cm$^2$ gauge)—5.6

The product yarn was knitted into a single-jersey fabric having the characteristic spun yarn aesthetics and an improved stability against distortion provided by those filaments of the nylon yarn which remained unbroken.

EXAMPLE 6

Carrier yarn—100/25 POY polyester spun at 5,000 m/min
Extensible yarn—80/50 POY polyester spun at 3200 m/min
Feed rolls speed (m/min)—230
Draw rolls speed (m/min)—248
Take-up speed (m/min)—244
Spindle speed of Barmag unit (r.p.m.)—11,000
Air pressure of interlacing jet (kg/cm$^2$ gauge)—4.9

A knitted pile fabric was made in a plain plush construction using the product yarn to form the pile and a 167/32 false-twist texturised "Lirelle" polyester yarn to form the backing. The fabric had 10.75 courses/cm, 9.5 wales/cm and a pile height of 3.5 mm. This 100 percent polyester terry fabric had a very soft pile and was similar in appearance to cotton terry fabrics.

EXAMPLE 7

Carrier yarn—44/10 fully drawn "Celon" nylon 6 yarn
Extensible yarn—60/20 undrawn nylon 6 yarn spun at 1000 m/min
Feed rolls speed (m/min)—250
Draw rolls speed (m/min)—254
Take-up speed (m/min)—244
Spindle speed of Barmag unit (r.p.m.)—10,000
Air pressure of interlacing jet (kg/cm$^2$ gauge)—4.9

When circular knitted into a single-jersey fabric the 100 percent nylon yarn gave a soft handle and a spun-look to the fabric.

EXAMPLE 8

Carrier yarn—44/10 fully drawn "Celon" nylon 6 yarn
Extensible yarn—120/40 undrawn nylon 6 yarn spun at 1000 m/min
Feed rolls speed (m/min)—244
Draw rolls speed (m/min)—254
Take-up speed (m/min)—244
Spindle speed of Barmag unit (r.p.m.)—10,000
Air pressure of interlacing jet (kg/cm$^2$ gauge)—5.6

The product yarn was characterised not only by broken-filaments which gave it spun-yarn aesthetics but also by intermittent slubs formed by local entanglements of the broken filaments. These slubs were of a very similar character to the slubs produced by conventional methods in spun yarn and were stable against being pulled out. The yarn was knitted into a single-jersey fabric in which the slubs were apparently random in distribution, thereby adding to the "natural" appearance and texture of the fabric.

EXAMPLE 9

Carrier yarn—44/10 fully drawn "Celon" nylon 6 yarn
Extensible yarn—120/40 undrawn nylon 6 yarn spun at 1000 m/min
Feed rolls speed (m/min)—248
Draw rolls speed (m/min)—254
Take-up speed (m/min)—244
Spindle speed of Barmag unit (r.p.m.)—10,000
Air pressure of interlacing jet (kg/cm$^2$ gauge)—5.6

The increase in tension produced by the reduced speed of the feed rolls as compared with that used in Example 8, resulted in a slub yarn with smaller slubs but otherwise similar in character to that produced in Example 8.

EXAMPLE 10

Carrier yarn—100/25 POY polyester spun at 5000 m/min
Extensible yarn—167/32 polyester yarn spun at 2000 m/min and then cold drawn at a draw ratio of 2.1:1
Feed rolls speed (m/min)—230
Draw rolls speed (m/min)—248
Take-up speed (m/min)—244
Spindle speed of Barmag unit (r.p.m.)—11,000
Air pressure of interlacing jet (kg/cm$^2$ gauge)—4.9

The product yarn had a spun yarn look by virtue of the broken filaments on its surface. When knitted into single jersey fabric and dyed with a disperse dye as described in Example 2, a slub effect was produced.

These were not true slubs as produced in Examples 8 and 9 but were what is known as dyeability slubs produced by differential dyeability along the length of the 167/32 component. This differential resulted from uneven orientation produced by cold-drawing.

EXAMPLE 11

Carrier yarn—100/25 POY polyester spun at 5000 m/min and 2/167/42 "Dicel" (Trade Mark) cellulose diacetate yarn
Extensible yarn—167/50 POY polyester spun at 3000 m/min
Feed rolls speed (m/min)—100
Draw rolls speed (m/min)—102
Take-up speed (m/min)—102
Spindle speed of Barmag unit (r.p.m.)—12,000
Heater temperature (°C.)—182
Heater length (cms)—100
Air pressure of interlacing jet (kg/cm$^2$ gauge)—4.9

The resulting yarn was highly crimped as well as having broken filaments on its surface which made it like a spun yarn. It was weft-knitted on a flat-bed knitting machine in a 1×1 rib construction to produce a fabric suitable as high-bulk knitwear.

EXAMPLE 12

Carrier yarn—100/25 POY polyester spun at 5000 m/min and 2/167/32 "Tricel" (Trade Mark) cellulose triacetate yarn
Extensible yarn—167/50 POY polyester spun at 3000 m/min
Feed rolls speed (m/min)—100
Draw rolls speed (m/min)—103
Take-up speed (m/min)—104
Spindle speed of Barmag unit (r.p.m.)—12,000
Heater temperature (°C.)—182
Heater length (cms)—100
Air pressure of interlacing jet (kg/cm$^2$ gauge)—4.9

The highly-crimped product yarn was similar to that produced in Example 11 and was suitable for use in high-bulk knitwear.

What is claimed is:

1. A process for making a textured yarn comprising combining a carrier yarn component with an extensible yarn component comprising continuous filaments of a synthetic polymeric material and having an extensibility of greater than 60 percent, and false-twisting the combined yarn under tension using a false-twist texturising unit employing rotary friction elements so as to break at least some of the filaments of the extensible yarn component intermittently along the length of the yarn whilst maintaining the carrier yarn component substantially intact.

2. A process claimed in claim 1 in which the false-twist is not heat set into the yarn as crimp.

3. A process as claimed in claim 1 in which the extensible yarn component is an undrawn yarn or a POY comprising polyamide or polyester filaments.

4. A process as claimed in claim 1 in which the tension in the yarn being false twisted is increased to a level at which the broken filaments of the extensible yarn component snarl and form slubs in the yarn.

5. A process as claimed in claim 1 in which the extensible yarn component is wrapped around the carrier yarn component to combine them.

6. A process as claimed in claim 1 in which the yarn is interlaced after the false-twisting step.

7. A textured yarn produced by a process as claimed in claim 1.

* * * * *